US008870017B2

(12) United States Patent
Reeber et al.

(10) Patent No.: US 8,870,017 B2
(45) Date of Patent: Oct. 28, 2014

(54) BOTTLE FOR FLOWABLE PRODUCT

(75) Inventors: Margaret Reeber, Columbus, OH (US); Mark Borger, York, PA (US); Michael Stephan, Lititz, PA (US); Wayne Perring, York, PA (US); David Heisner, York, PA (US)

(73) Assignee: Abbott Laboratories, Abbott Park, IL (US)

( * ) Notice: Subject to any disclaimer, the term of this patent is extended or adjusted under 35 U.S.C. 154(b) by 16 days.

(21) Appl. No.: 13/294,316

(22) Filed: Nov. 11, 2011

(65) Prior Publication Data

US 2012/0325770 A1 Dec. 27, 2012

Related U.S. Application Data

(60) Provisional application No. 61/500,307, filed on Jun. 23, 2011.

(51) Int. Cl.

| | |
|---|---|
| ***B65D 8/12*** | (2006.01) |
| ***B65D 79/00*** | (2006.01) |
| ***B65D 1/02*** | (2006.01) |

(52) U.S. Cl.

CPC ..... *B65D 79/005* (2013.01); *B65D 1/0207* (2013.01)

USPC ..... 220/673; 220/675; 220/669; 215/382

(58) Field of Classification Search

USPC ..... 220/673, 675, 669, 670; 215/381, 382, 215/383, 384

See application file for complete search history.

(56) References Cited

U.S. PATENT DOCUMENTS

| | | | |
|---|---|---|---|
| D20,059 | S | 7/1890 | Irwin |
| D56,029 | S | 8/1920 | Quigg |
| D120,277 | S | 4/1940 | Steelman |
| D167,345 | S | 7/1952 | Fuerst |
| D174,646 | S | 5/1955 | Lorenzen |
| D216,361 | S | 12/1969 | Pappas |
| D264,433 | S | 5/1982 | Pettengill |
| D264,434 | S | 5/1982 | Pettengill |
| D286,617 | S | 11/1986 | Goodwin |

(Continued)

FOREIGN PATENT DOCUMENTS

| | | | |
|---|---|---|---|
| WO | 2005115850 | A1 | 12/2005 |
| WO | 2010040081 | A1 | 4/2010 |

OTHER PUBLICATIONS

International Search Report and Written Opinion of PCT/US2011/060374; Jan. 25, 2012; 11 pages.

(Continued)

*Primary Examiner* — Jeffrey Allen

(74) *Attorney, Agent, or Firm* — Calfee, Halter & Griswold LLP

(57) ABSTRACT

A bottle has a body intermediate a neck and a closed bottom of the bottle. The body has an exterior surface defining a circumference of the body. The body includes a plurality of panel segments. Each panel segment has an upper panel end, a lower panel end, a length extending from the upper panel end to the lower panel end, opposite longitudinal sides, and a panel centerline extending at a substantially constant acute angle relative to the longitudinal axis of the bottle. The panel segments are disposed generally side-by-side around the circumference of the body. The exterior surface of each panel segment may be substantially planar along the circumferential width of the panel segment.

15 Claims, 10 Drawing Sheets

(56) References Cited

U.S. PATENT DOCUMENTS

| | | | | |
|---|---|---|---|---|
| 5,593,056 | A | 1/1997 | Mero et al. | |
| D380,356 | S | 7/1997 | Husted | |
| 5,704,504 | A | 1/1998 | Bueno | |
| 5,785,197 | A | 7/1998 | Slat | |
| D406,065 | S | 2/1999 | Cheng | |
| D407,317 | S | 3/1999 | Lang | |
| D416,198 | S | 11/1999 | Lindsay et al. | |
| D443,519 | S | 6/2001 | Warner et al. | |
| D479,131 | S | 9/2003 | Warner et al. | |
| D489,268 | S | 5/2004 | Wang | |
| D495,601 | S | 9/2004 | Klemm et al. | |
| D505,333 | S | 5/2005 | Bretz et al. | |
| D514,938 | S | 2/2006 | Zhang | |
| 7,178,684 | B1 * | 2/2007 | Budden et al. | 215/381 |
| 7,198,165 | B2 | 4/2007 | Zhang | |
| D548,088 | S | 8/2007 | Urgrady | |
| D548,095 | S | 8/2007 | MgGuinness | |
| D552,476 | S | 10/2007 | Yelland | |
| D575,161 | S | 8/2008 | Lepoitevin | |
| 7,467,725 | B2 * | 12/2008 | Tanaka et al. | 215/381 |
| 7,604,140 | B2 | 10/2009 | Pritchett, Jr. et al. | |
| D675,535 | S | 2/2013 | Nomura et al. | |
| 2002/0000421 | A1 | 1/2002 | Ota et al. | |
| 2007/0688894 | | 3/2007 | Iawshita et al. | |
| 2009/0321384 | A1 | 12/2009 | Zhang et al. | |
| 2010/0032405 | A1 | 2/2010 | Ozawa et al. | |
| 2010/0089865 | A1 * | 4/2010 | Oguchi et al. | 215/382 |
| 2011/0108515 | A1 * | 5/2011 | Gill et al. | 215/381 |

OTHER PUBLICATIONS

Notice of Allowance from U.S. Appl. No. 29/394,976 mailed Aug. 29, 2013.

Office Action from Canadian Application No. 151896 dated Mar. 6, 2014.

Office Action from Canadian Application No. 151897 dated Mar. 6, 2014.

Office Action from Canadian Application No. 2834779 dated Jun. 2, 2014.

* cited by examiner

BOTTLE FOR FLOWABLE PRODUCT

CROSS REFERENCE TO RELATED APPLICATION

This application claims the benefit of U.S. Provisional Application No. 61/500,307 filed Jun. 23, 2011, which is incorporated herein in its entirety.

BACKGROUND

The field of the invention relates generally to a bottle for a flowable product.

One process of packaging a flowable product (e.g., liquid product) in a bottle is called hot filling. Hot filling generally involves filling the bottle with the flowable product at a temperature of about 90° C., sealing the bottle with a cap, and cooling the capped bottle. As the product in the bottle cools, a vacuum or reduced internal pressure is created. This reduced internal pressure tends to deform (e.g., dent) the bottle. To inhibit this type of deformation or denting, some hot-filled bottles include depressurization-absorbing panels. These depressurization-absorbing panels deform (i.e., become dented) under reduced internal pressure in the bottle so that the bottle retains its basic, overall shape and appearance.

Another process of packaging a flowable product in a bottle is called aseptic filling. Aseptic filling generally involves filling the bottle under sterile or aseptic conditions so that there is no need to heat the product to a high temperature, as with hot filling, to reduce bacterial loads. As such, the problem of a vacuum or reduced internal pressure deforming the bottle is diminished, but not entirely avoided. There is still the possibility—and high likelihood—that the filled bottle will experience temperature changes from the time of filling until consumption by a consumer. In particular, the filled bottle experiences a temperature change when the consumer (or other person) refrigerates the bottle. Because the inside of the filled bottle cools in the refrigerator, a vacuum or reduced internal pressure is created. Although the magnitude of the reduced pressure in this situation may be less than the reduced pressure in a hot-filled bottle, the refrigerated, filled bottle may still undergo at least some deformation (e.g., denting) as a result of the reduced internal pressure.

In addition to the reduced internal pressure experienced during refrigeration of an aseptically filled bottle, the bottle may experience lateral deformation (e.g., denting) during handling or shipping and when being gripped by a consumer. These deformation forces tend to be applied inwardly, similar to the direction of force applied to the bottle due to the reduced internal pressure. The bottle may also experience longitudinal forces tending to crush the bottle lengthwise, particularly when stacking bottles during shipping

SUMMARY

In one aspect, a bottle having an open top, a closed bottom, and a longitudinal axis extending between the open top and the closed bottom generally comprises a neck and a body. The neck has an upper neck end defining the open top of the bottle, and a lower neck end. The body is intermediate the lower neck end and the closed bottom of the bottle. The body has an exterior surface defining a circumference of the body. The body includes a plurality of panel segments. Each panel segment has an upper panel end, a lower panel end, a length extending from the upper panel end to the lower panel end, opposite longitudinal sides, and a panel centerline extending at a substantially constant acute angle relative to the longitudinal axis of the bottle. The panel segments are disposed generally side-by-side around the circumference of the body.

In another aspect, a bottle having an open top, a closed bottom, and a longitudinal axis extending between the open top and the closed bottom generally comprises a neck and a body. The neck has an upper neck end defining the open top of the bottle, and a lower neck end. The body is intermediate the lower neck end and the closed bottom of the bottle. The body has an exterior surface defining a circumference of the body. The body includes a plurality of panel segments. Each panel segment has an upper panel end, a lower panel end, a length extending from the upper panel end to the lower panel end, and opposite longitudinal sides. The panel segments are disposed generally side-by-side around the circumference of the body. Each panel segment has a circumferential width extending between the opposite longitudinal sides of the panel segment. An exterior surface of each panel segment is substantially planar along the circumferential width of the panel segment.

In yet another aspect, a bottle having an open top, a closed bottom, and a longitudinal axis extending between the open top and the closed bottom generally comprises a neck, a body, and a plurality of panel segments. The neck has an upper neck end defining the open top of the bottle, and a lower neck end. The body is intermediate the lower neck end and the closed bottom of the bottle. The body has an exterior surface defining a circumference of the body. The body includes a plurality of panel segments, upper and lower body segments, and at least one of an upper circumferential transition portion and a lower circumferential transition portion. Each panel segment has an upper panel end, a lower panel end, a length extending from the upper panel end to the lower panel end, opposite longitudinal sides, and a centerline extending between the upper and lower panel ends and being offset from the longitudinal axis of the bottle. The panel segments are disposed generally side-by-side around the circumference of the body. The upper body segment is intermediate the lower neck end and the upper panel ends, and the lower body segment is intermediate the lower panel ends and the closed bottom of the bottle. The upper circumferential transition portion tapers inward from the upper body segment to the upper panel ends of the panel segments to define an upper circumferential edge at the intersection of the upper body segment and the upper circumferential transition portion. The lower circumferential transition portion tapers inward from the lower body segment to the lower panel ends of the panel segments to define a lower circumferential edge at the intersection of the lower body segment and the lower circumferential transition portion.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
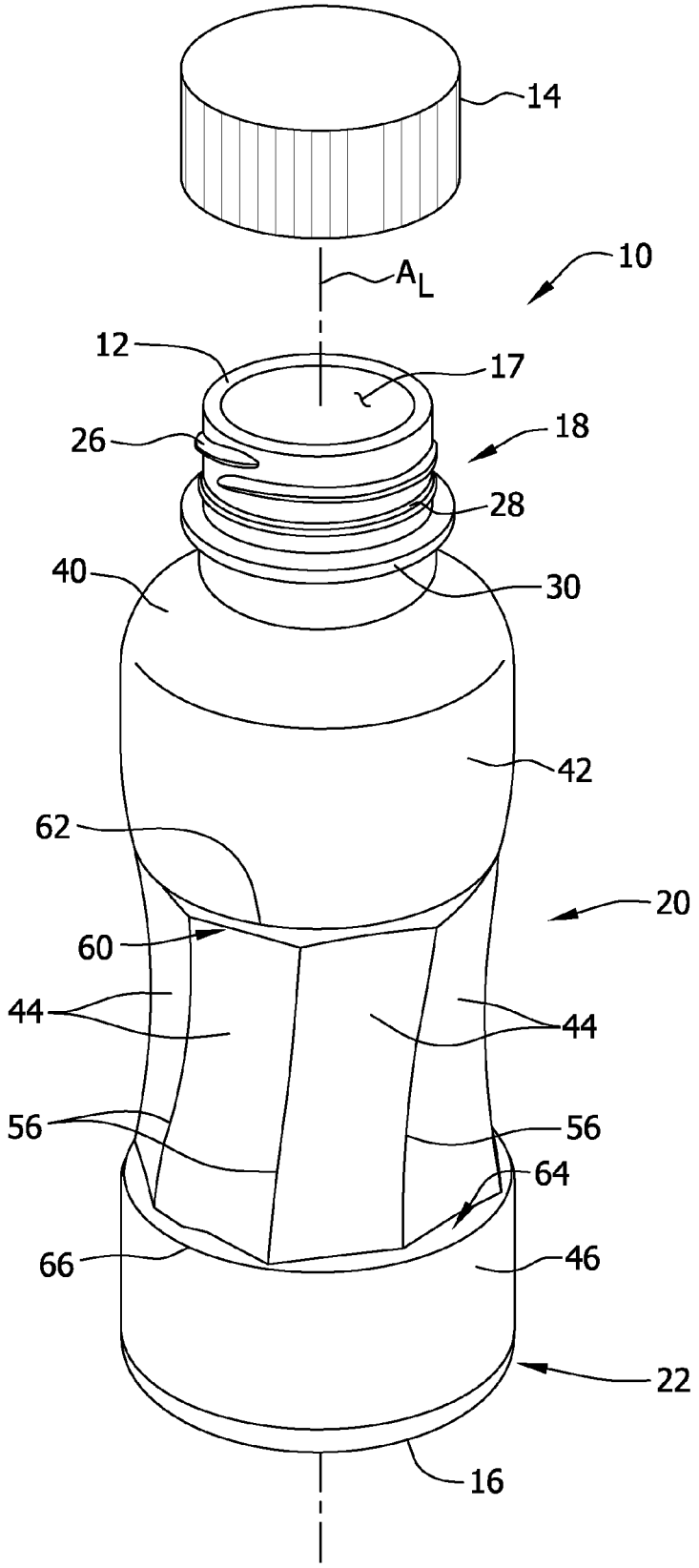
FIG. 1 is a perspective of one embodiment of a bottle, including a cap or closure exploded therefrom.
Figure 2:
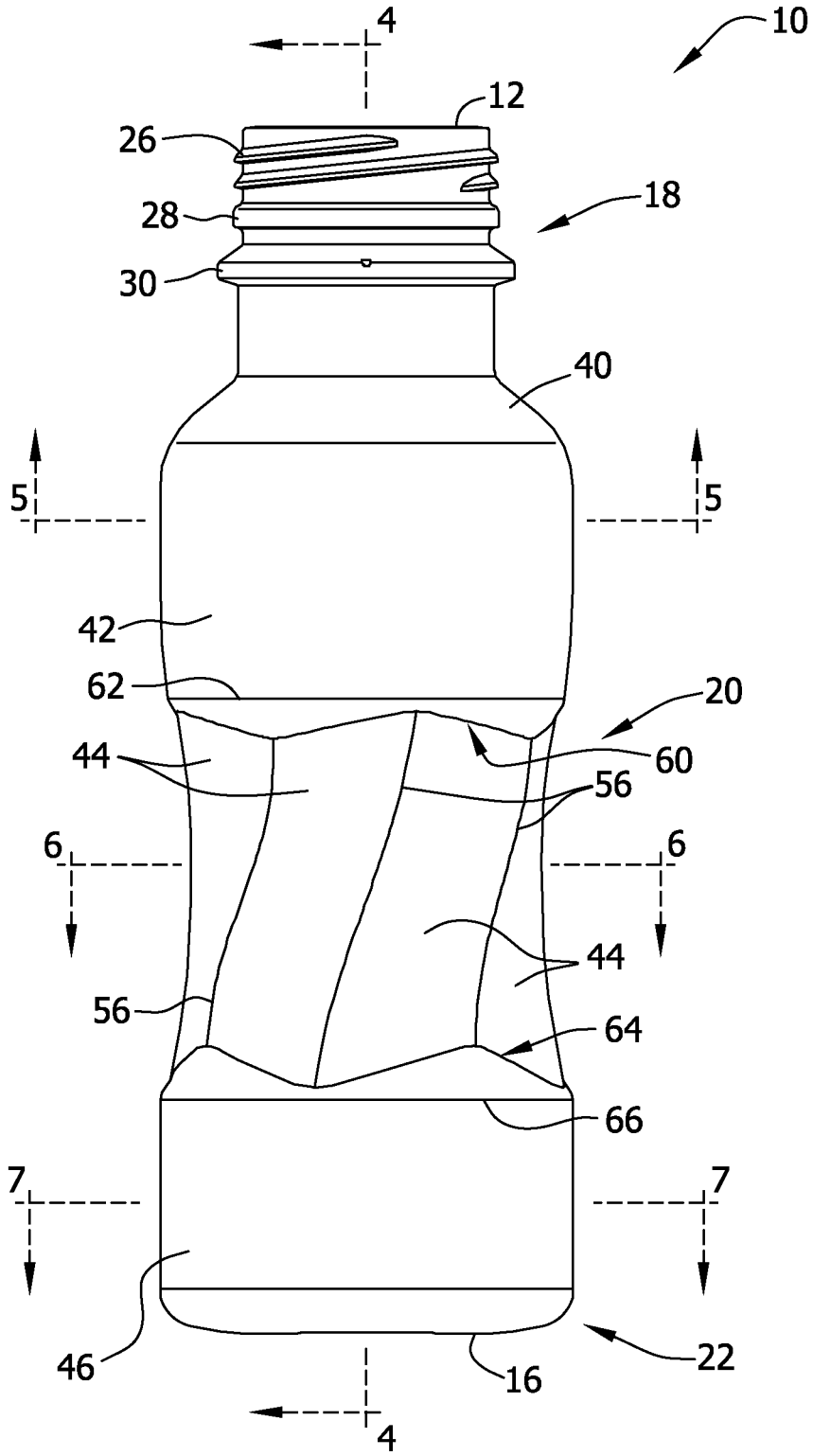
FIG. 2 is a front elevation of the bottle of FIG. 1.

Referring now to the drawings and in particular to FIGS. 1 and 2, the illustrated embodiment of a bottle is generally indicated at 10. The bottle 10 has an open top 12, to which a cap or closure 14 (FIG. 1) is removably securable (e.g., threadably securable) to close the open top, and a closed bottom 16 opposite the open top. A longitudinal axis $A_L$ of the bottle 10 extends between the open top 12 and the closed bottom 16. The bottle 10 is configured for holding a quantity of flowable product in an interior space 17 (FIG. 1) thereof, and allowing a consumer or user to pour out or drink the flowable product from the open top 12. In one example, the bottle 10 may have a suitable internal volume to hold about 10.2 fl. oz, although the bottle may be sized to hold a different amount of product. The flowable product inside the bottle 12 may include nutritional or medical liquid product for adult or pediatric nutrition, including but not limited to the following: fat; protein; carbohydrates; minerals; vitamins; probiotics; prebiotics; nutrients; compounds or concentrates that aid in digestion, nutrition, or improvement in physical health; complete or modular nutrition that aids in metabolism or alters how metabolism occurs; and other dietary supplements. The bottle 10 may be aseptically or terminally sterilized.

Referring still to FIGS. 1 and 2, the bottle 10 broadly comprises a neck, generally indicated at 18; a body, generally indicated at 20, disposed below the neck; and a base, generally indicated at 22, disposed below the body. In the illustrated embodiment, the neck 18, the body 20, and the base 22 are integrally formed as a one-piece structure. An upper end of the neck 18 corresponds with and defines the open top 12 of the bottle and is identified using the same reference numeral 12 in the drawings. In the illustrated embodiment, the neck 18 includes a continuous external thread 26 for releasably connecting the cap 14 to the bottle 10. In other embodiments, the neck 18 may include a plurality of external threads and/or the neck may include other types of connections for releasably connecting the cap 14 to the neck. In yet other embodiment, the neck 18 may be free from structures and components for releasably connecting the cap 14 to the neck.

The neck 18 also includes upper and lower circumferential beads 28, 30, respectively, below the external thread 26. A tamper-indicating band (not shown) is retained on the neck 18, between the upper and lower circumferential beads 28, 30, after the cap 14 is detached from the tamper-indicating band. The lower circumferential bead 30 also facilitates gripping of the bottle 10 by a filling machine during an automated filling operation. In other embodiments, the neck 18 may include other components or structures to retain a tamper-indicating band on the neck 18 of the bottle 10, and/or the neck may include other components or structures for facilitating gripping of the bottle by a filling machine. It is understood that the neck 18 may be free from components and structures that retain a tamper-indicating band on the neck of the bottle 10, and/or the neck may be free from other components or structures for facilitating gripping of the bottle by a filling machine.

Figure 3:
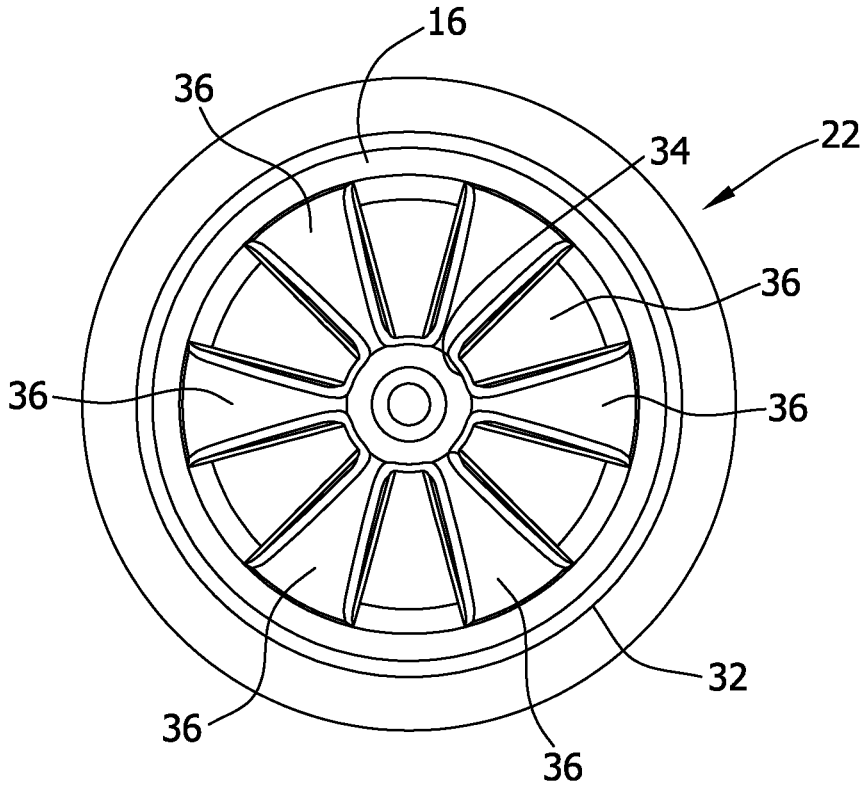
FIG. 3 is a bottom plan of the bottle of FIG. 1.
Figure 4:
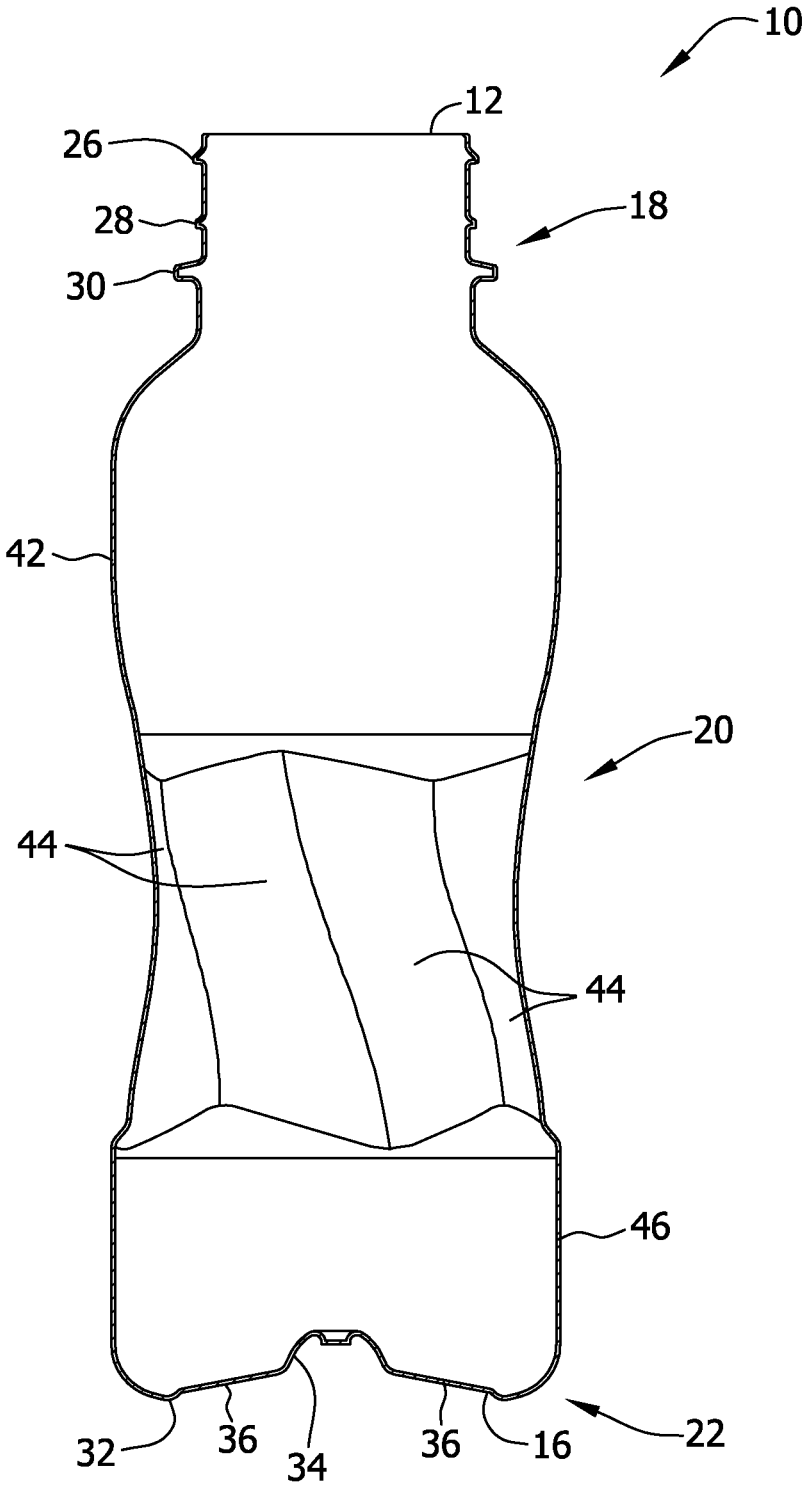
FIG. 4 is a longitudinal section of the bottle taken along the line 4-4 in FIG. 2.

Referring to FIGS. 3 and 4, the base 22 defines the closed bottom 16 of the bottle 10. In the illustrated embodiment, the bottom 16 has an outer annular support portion 32, lying generally within a plane; a central concave portion 34; and a plurality of ribs 36 spaced apart around the longitudinal axis $A_L$. When the bottle 10 is resting upright on a flat surface, the annular support portion 32 contacts the flat surface. Each of the ribs 36 extends radially between the central concave portion 34 and the annular support portion 32. The plurality of ribs 36 provide strength and rigidity to the base 22 so that the base can support the weight of the bottle 10. It is understood that the base 22 may be of other configurations without departing from the scope of the present invention.

Referring to FIGS. 1 and 4, the body 20 has an exterior surface defining a circumference. The body 20 generally includes a shoulder 40 disposed below the neck 18; an upper body segment 42 disposed below the shoulder; a plurality of panel segments, each indicated at 44, disposed below the upper body segment; and a lower body segment 46 intermediate the panel segments and the base 22. In the illustrated embodiment, the shoulder 40 extends downward and laterally outward from a lower end of the neck 18, although it is understood that the shoulder may extend laterally outward, and not downward, from the neck. It is also understood that in other embodiments the bottle 10 may not include a shoulder.

Figure 5:
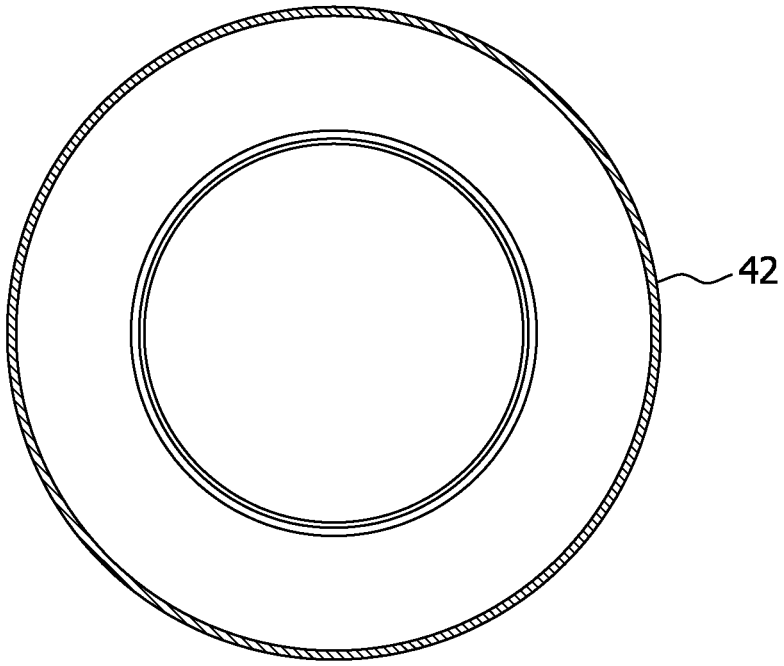
FIG. 5 is a cross section of the bottle taken along the line 5-5 in FIG. 2.

Referring to FIGS. 1, 2, 4, and 5, the upper body segment 42 extends downward from the shoulder 40 and is intermediate the shoulder and the panel segments 44. As illustrated in FIGS. 4 and 5, the upper body segment 42 is substantially bilaterally symmetrical and generally cylindrical with a slight downward taper toward the panel segments 44. It is understood that in other embodiments the upper body segment 42 may be of other shapes. For example, the upper body segment 42 may be generally polygonal and/or asymmetrical. The illustrated upper body segment 42 may have a maximum circumference from about 6.3 in (16.0 cm) to about 9.4 in (23.9 cm) and a maximum cross-sectional diameter from about 2 in (5.08 cm) to about 3 in (7.62 cm), although the upper body segment may be of other sizes. In the illustrated embodiment, the circumference of the upper body segment 42 is greater than the circumference of the body 20 at the panel segments 44.

With reference to FIGS. 1, 2, 4, and 7, the lower body segment 46 extends upward from the base 22 and is intermediate the base and the panel segments 44. As seen best in FIGS. 4 and 7, the lower body segment 46 is substantially bilaterally symmetrical and generally cylindrical with substantially uniform circumference along the longitudinal axis $A_L$. It is understood that in other embodiments the lower body segment 46 may be of other shapes. For example, the lower body segment 46 may be generally polygonal and/or asymmetrical. The lower body segment 46 in one embodiment may have a circumference from about 6.3 in (16.0 cm) to about 9.4 in (23.9 cm) and a cross-sectional diameter from about 2 in (5.08 cm) to about 3 in (7.62 cm), although the lower body segment may be of other sizes. In the illustrated embodiment, the circumference of the lower body segment 46 is greater than the circumference of the body 20 at the panel segments 44. The cross-sectional diameter of the lower body segment 46 is substantially equal to the maximum cross-sectional diameter of the upper body segment 42, and the circumference of the lower body segment is equal to the maximum circumference of the upper body segment.

Figure 8:
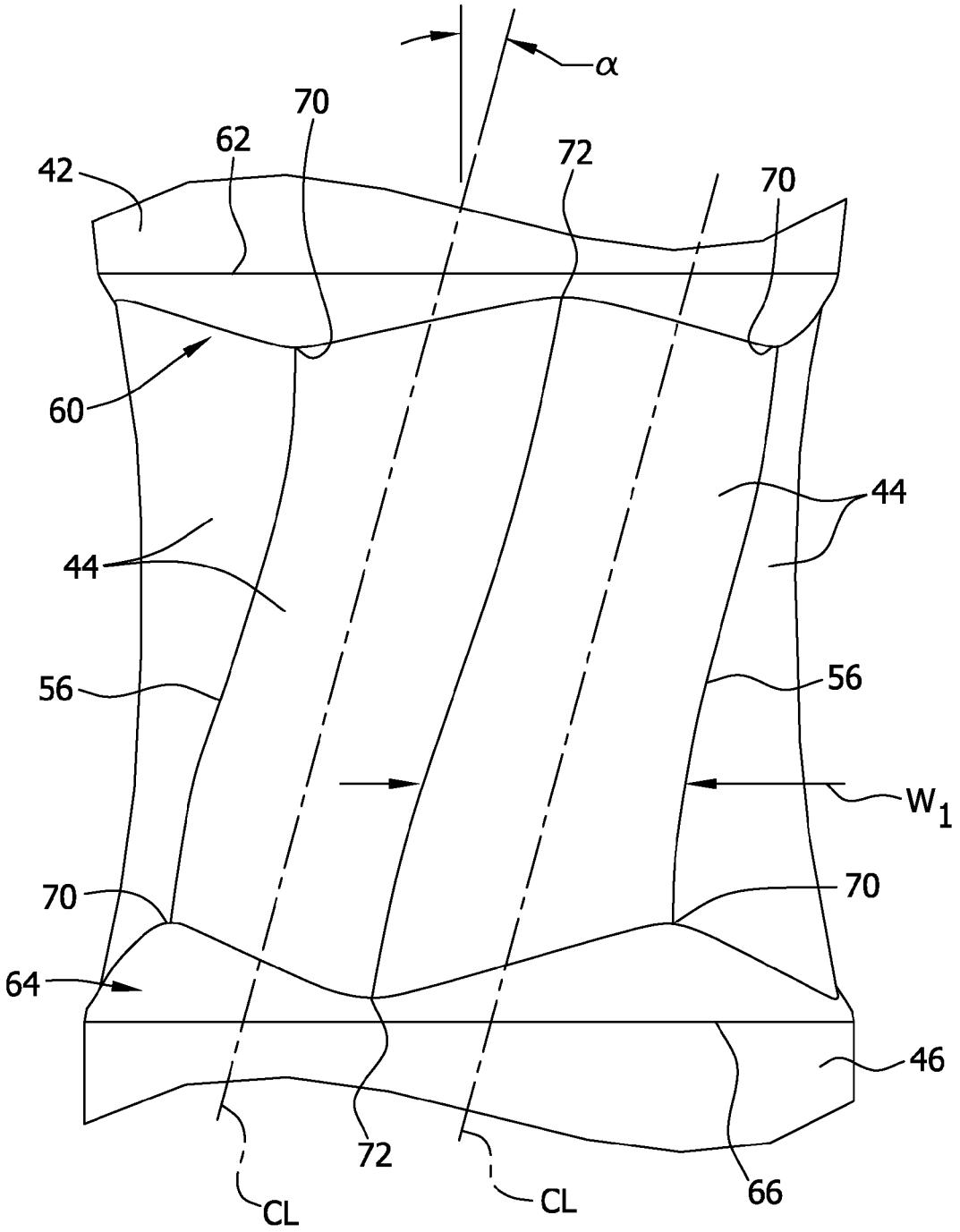
FIG. 8 is an enlarged, partial front elevation of the bottle of FIG. 1, illustrating panel segments of the bottle.

Referring to FIG. 8, each panel segment 44 has a length, opposite longitudinal sides 50, and a centerline CL extending from a lower panel end 52 to an opposite upper panel end 54. In the illustrated embodiment, the panel centerline CL of each panel segment 44 extends at a constant acute angle $\alpha$ relative to the longitudinal axis $A_L$ of the bottle 10. Through this arrangement, the panel segments 44 extend diagonally across the bottle 10. In general, the illustrated panel segments 44 provide rigidity and strength to the bottle 10 to inhibit deformation, such as lateral denting and/or longitudinal crushing, when the filled bottle is cooled (eg., when refrigerated). More specifically, the panel segments 44—by virtue of the panel segments extending at the substantially constant acute angle $\alpha$ relative to the longitudinal axis $A_L$ of the bottle 10—provide rigidity and strength both longitudinally, to inhibit longitudinal deformation (e.g., crushing), and laterally inward, to inhibit lateral deformation (e.g., denting). In one example, the constant acute angle $\alpha$ at which the centerline CL of each panel segment 44 extends relative to the longitudinal axis $A_L$ of the bottle 10 measures from about 2 degrees to about 15 degrees, and more specifically, from about 5 degrees to about 10 degrees. It is understood that in other embodiments, the panel segments 44 may extend substantially parallel to the longitudinal axis $A_L$ of the bottle 10, or the panel segments 44 may be extend at a non-constant angle (e.g., have an S-shape) relative to the longitudinal axis of the bottle.

The panel segments 44 are arranged side-by-side around the circumference of the body 20 such that the longitudinal sides 50 of adjacent panel segments define longitudinal panel edges 56 on the exterior surface of the body. The illustrated longitudinal panel edges 56 are radiused along their respective lengths to smooth out sharp edges. As seen best in FIG. 8, in the illustrated embodiment, each panel segment 44 has a constant circumferential width $W_1$ along the entire length of the panel, and the circumferential widths of the panel segments are substantially equal. Moreover, the longitudinal panel edges 56 are substantially uniformly spaced about the circumference of the body, and each panel edge extends at a constant, acute angle relative to the longitudinal axis $A_L$ of the bottle 10 that is equal to the constant, acute angle $\alpha$ at which the centerline CL of each panel segment. Thus, the panel segments 44 would be substantially parallel to one another in an unwrapped, elevational view. That is, the panel segments 44 would be substantially parallel to one another if the bottle 10 was cut lengthwise, parallel to the longitudinal axis $A_L$, and unwrapped and flattened. It is understood that in other embodiments, the circumferential widths $W_1$ of the panel segments 44 may not be constant along their respective lengths and/or the circumferential widths of the panel segments may not be substantially equal.

In the illustrated embodiment, bottle 10 includes 8 panel segments 44. In other embodiments, however, the bottle may include more than 8 panel segments (e.g., 9, 10, 11, 12 or 13 panel segments) or less than 8 panel segments (e.g., 7, 6, 5, or 4 panel segments). Moreover, in the illustrated embodiment the rear, left, and right elevational views of the bottle 10—apart from the continuous thread 26—are substantially identical to the front elevational view (FIG. 2). That is, the bottle 10 has the same appearance—other than the continuous thread 26—regardless of whether it is viewed from the front, rear, left or right. It is understood that in other embodiments, the bottle 10 may have different appearances, depending on the point of view.

Referring to FIGS. 1, 2, and 4, each panel segment 44 has an exterior surface that curves inward toward the longitudinal axis $A_L$ of the bottle 10 along at a least a portion of the length of the panel segment. In particular, in the illustrated embodiment the exterior surface of each panel segment 44 is generally concave along substantially an entirety of the length of the panel segment to facilitate gripping of the bottle 10 by a hand of the user. In other embodiments, the exterior surfaces of the panel segments 44 may not be generally concave along their respective lengths. As non-limiting examples, the exterior surfaces of the panels segments 44 may be generally planar or generally convex along their respective lengths.

Figure 6:
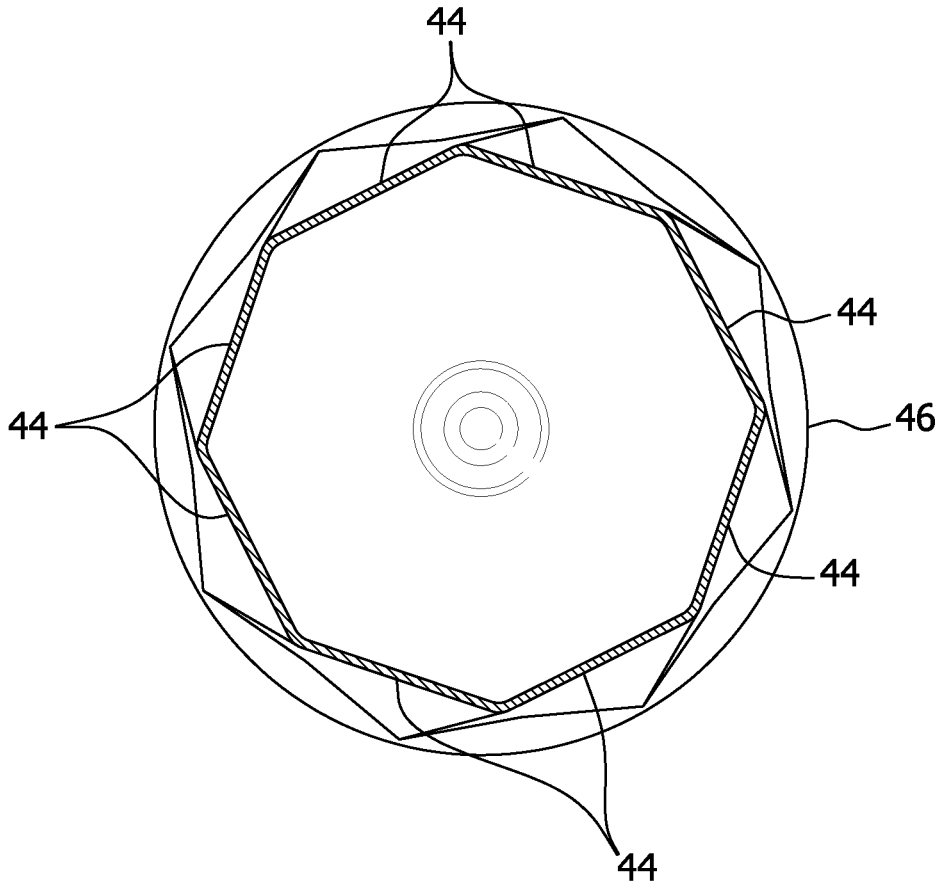
FIG. 6 is a cross section of the bottle taken along the line 6-6 in FIG. 2.
Figure 7:
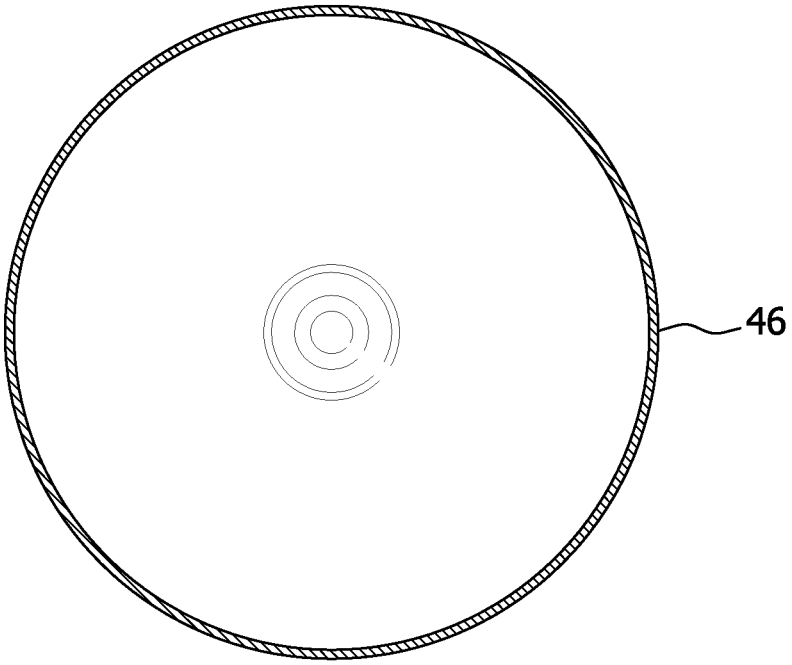
FIG. 7 is a cross section of the bottle taken along the line 7-7 in FIG. 2.

As seen best in FIG. 6, in the illustrated embodiment the exterior surface of each panel segment 44 is also substantially planar along the circumferential width $W_1$ of the panel segment, thus providing an increased surface area for gripping by the user. In other embodiments, the exterior surfaces of the panel segments 44 may not be substantially planar along their respective circumferential widths $W_1$. As non-limiting examples, the exterior surfaces of the panels segments 44 may be generally planar or generally convex along their respective circumferential widths $W_1$.

In the illustrated embodiment, the body 20 includes an upper circumferential transition portion, generally indicated at 60, tapering inward (i.e., toward the longitudinal axis of the bottle) from the upper body segment 42 to the upper panel ends of the panel segments 44. An upper circumferential edge 62 is defined at the intersection of the upper body segment 42 and the upper circumferential transition portion 60. The body 20 also includes a lower circumferential transition portion, generally indicated at 64, tapering inward (i.e., toward the longitudinal axis $A_L$ of the bottle 10) from the lower body segment 46 to the lower panel ends of the panel segments 44. A lower circumferential edge 66 is defined at the intersection of the lower body segment 46 and the lower circumferential transition portion 64. It is understood that in other embodiments, the bottle 10 may not include one or more of the upper and lower circumferential transition portions 60, 64 and the lower and upper circumferential edges 62, 66. In one embodiment, the bottle 10 may include only one of the lower and upper circumferential edges 62, 66 and only one of the upper and lower circumferential transition portions 60, 64. The upper and lower circumferential edges 62, 66 facilitate gripping by the user acting as stops for the user's hand and inhibiting the user's hand from sliding longitudinally along the bottle 10.

In general, in the illustrated embodiment each of the upper and lower transition portions 60, 64 has a plurality of generally triangular-shaped segments, each of which extending across pairs of adjacent panel segments 44 from one side of one of the adjacent panel segments to an opposite side of the other adjacent panel segment. Through this arrangement, the upper and lower circumferential transition portions 60, 64 each have a generally serrated-shaped edge extending around the circumference of the body 20. As seen in FIG. 8, peaks 70 and valleys 72 of the serrated-shaped edge of the upper and lower circumferential transition portions 60, 64 intersect the longitudinal edges 56 of the body 20. In other embodiments, one or both of the upper and lower circumferential transition portions 60, 64 may not have a serrated-shaped edge.

In one embodiment, the bottle 11 may be formed, such as by molding, as a one-piece component, and the cap 30 may be formed, such as by molding, as a separate one-piece component. Each of the bottle 11 and the cap 30 may be formed from plastic, including, but not limited to, polyethylene terephthalate (PETE), high density polyethylene (HDPE), low density polyethylene (LDPE), polyvinyl chloride (PVC), polypropylene, polysterene (PS), and polycarbonates. In one embodiment, the bottle 11 is suitable for either or both low acid aseptic filling and high acid aseptic filling. It is understood, however, that the bottle 10 may be formed in other suitable ways and from other suitable materials.

In general, the illustrated panel segments 44 provide rigidity and strength to the bottle 10 to inhibit deformation, such as lateral denting and/or longitudinal crushing, when the bottle filled with product is cooled, such as when refrigerated. More specifically, the panel segments 44—by virtue of the panel segments extending at a substantially constant acute angle relative to the longitudinal axis $A_L$ of the bottle 11—provide rigidity and strength both longitudinally, to inhibit longitudinal deformation (e.g. crushing), and laterally inward, to inhibit lateral deformation (e.g., denting). In addition to providing rigidity and strength, the illustrated panel segments 44—by virtue of the panel segments being curved inward (e.g., concave)—provide a gripping area that facilitates gripping of the bottle 11 by a user's hand. Moreover, the upper and lower circumferential edges 62, 66, at the intersections of the upper and lower transition portions 60, 64 and the respective upper and lower body segments 42, 46, also facilitates gripping the user by acting as stops for the user's hand and inhibiting the user's hand from sliding longitudinally along the bottle 11.

Figure 9:
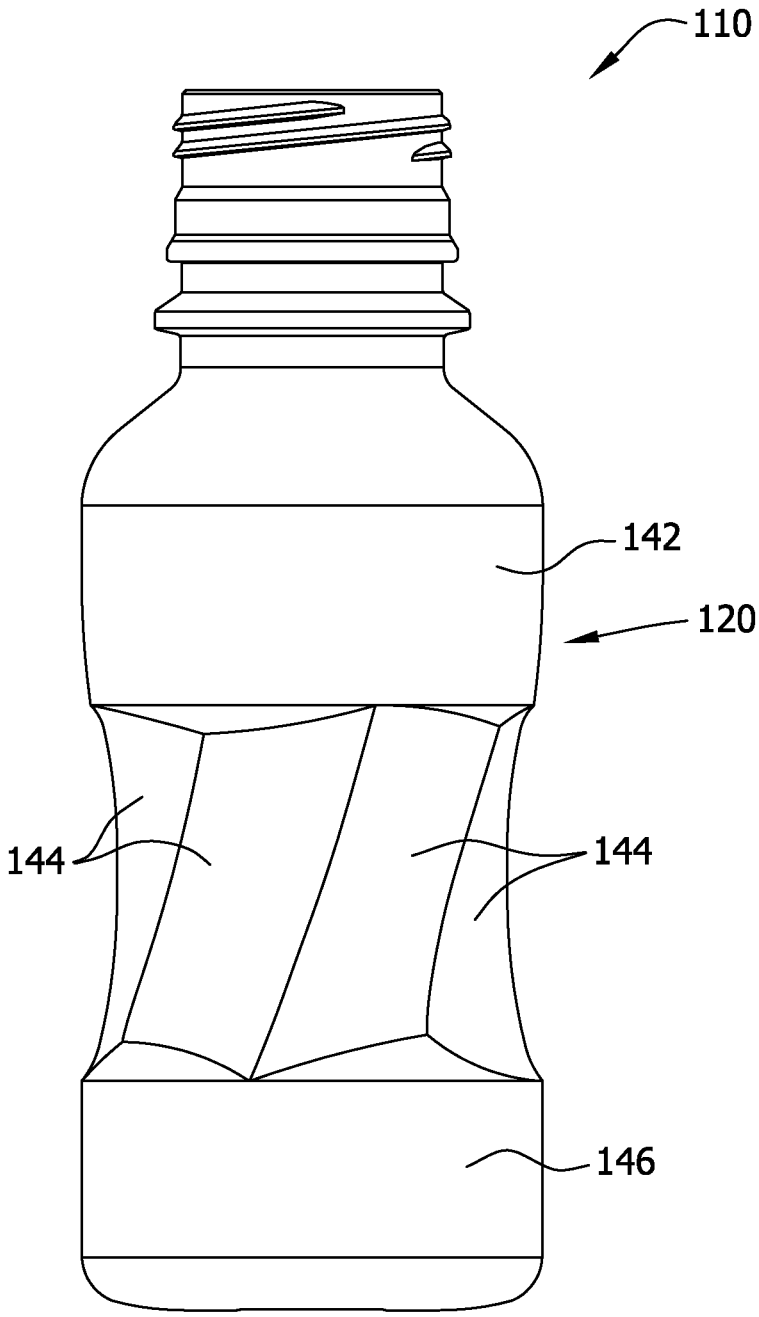
FIG. 9 is a front elevation of a second embodiment of the bottle, a cap or closure being removed therefrom.
Figure 10:
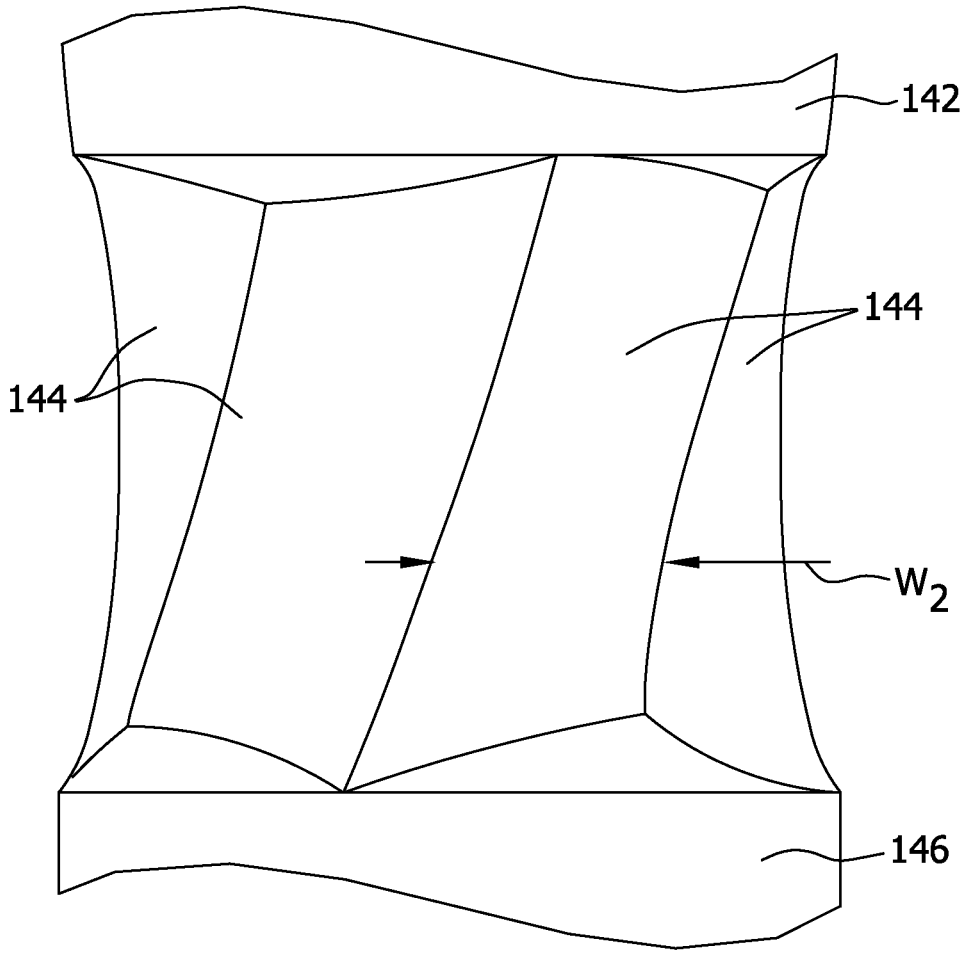
FIG. 10 is an enlarged, partial front elevation of the bottle of FIG. 9, illustrating panel segments of the bottle.

Referring to FIGS. 9 and 10, a second embodiment of the bottle is generally indicated at 110. This second bottle embodiment 110 is similar to the first bottle embodiment 10 illustrated in FIGS. 1-8 and described above, and like components are indicated by corresponding reference numerals plus 100. Overall, the main difference between the second bottle embodiment 110 and the first bottle embodiment 10 is that the body 120 of the second bottle embodiment is shorter that the body 20 of the first bottle embodiment, and the circumferences of the body at the upper body segment 142 and the lower body segment 146 of the second bottle embodiment are greater than the respective circumferences of the first bottle embodiment. In addition, the widths $W_2$ of the panel segments 144 of the second bottle embodiment 110 are greater than the widths $W_1$ of the panel segments 44 of the first bottle embodiment 10, and the lengths of the panel segments of the second bottle embodiment are less than the lengths of the panel segments of the first bottle embodiment. Other than the differences in dimensions, however, the first and second bottle embodiments 10, 110 are substantially identical.

As various changes could be made in the above constructions and methods without departing from the scope of the invention, it is intended that all matter contained in the above description and shown in the accompanying drawings shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A bottle having an open top, a closed bottom, and a longitudinal axis extending between the open top and the closed bottom, the bottle comprising:

a neck having an upper neck end defining the open top of the bottle, and a lower neck end; and a body intermediate the lower neck end and the closed bottom of the bottle, the body having an upper body segment, a center body segment, and a lower body segment, the center body having an exterior surface defining a circumference and including a plurality of panel segments, each panel segment having an upper panel end, a lower panel end, a length extending from the upper panel end to the lower panel end, opposite longitudinal sides, and a panel centerline extending at a constant acute angle relative to the longitudinal axis of the bottle, the panel segments being disposed side-by-side and contiguous around the circumference of the body;

wherein each panel segment extends from the upper panel end to the lower panel end in a sinusoidal direction about the panel centerline, and the circumferential shape of the center body is a polygon at any point along a majority of the length of the center body.

2. The bottle set forth in claim 1, wherein each panel segment has an exterior surface that curves inward toward the longitudinal axis of the bottle along at least a portion of the length of the panel segment.

3. The bottle set forth in claim 1, wherein each panel segment has an exterior surface and a circumferential width extending between the opposite longitudinal sides of the panel segment, the exterior surface of each panel segment being substantially planar along the circumferential width of the panel segment.

4. The bottle set forth in claim 3, wherein the circumferential width of each panel segment is equal to the circumferential width of any other panel segment at any point along an entirety of the length of the panel segment.

5. The bottle set forth in claim 2, wherein each panel segment has a circumferential width extending between the opposite longitudinal sides of the panel segment, the exterior surface of each panel segment being substantially planar along substantially an entirety of the circumferential width of the panel segment.

6. The bottle set forth in claim 1, wherein the body includes an upper circumferential transition portion tapering inward from the upper body segment to the upper panel ends of the panel segments to define an upper circumferential edge at the intersection of the upper body segment and the upper circumferential transition portion, and a lower circumferential transition portion tapering inward from the lower body segment to the lower panel ends of the panel segments to define a lower circumferential edge at the intersection of the lower body segment and the lower circumferential transition portion.

7. The bottle set forth in claim 1, wherein each of the upper and lower body segments is generally cylindrical.

8. The bottle set forth in claim 6, wherein each of the upper and lower circumferential transition portions has a plurality of generally triangular-shaped segments, each triangular-shaped segment extending across a pair of adjacent panel segments from one side of a one of the adjacent panel segments to an opposite side of the other adjacent panel segment.

9. The bottle set forth in claim 1, wherein the longitudinal sides of adjacent panel segments intersect one another to define longitudinal panel edges on the exterior surface of the body.

10. The bottle set forth in claim 1, wherein the acute angle at which the panel centerline extends relative to the longitudinal axis of the bottle measures between about 2 degrees and about 15 degrees.

11. A bottle having an open top, a closed bottom, and a longitudinal axis extending between the open top and the closed bottom, the bottle comprising:

a neck;

a body disposed between the neck and the closed bottom, the body having an upper portion, a center portion and a lower portion, the upper portion and the lower portion being substantially cylindrical shaped, and the center portion having a plurality of panel segments, each panel segment having an upper panel end, a lower panel end, a length extending from the upper panel end to the lower panel end, and a centerline extending between the upper and lower panel ends and being offset from the longitudinal axis of the bottle, the panel segments being disposed side-by-side and contiguous around the circumference of the body;

wherein an exterior surface of each panel segment is planar in the circumferential direction and the circumferential width of each panel segment is equal to all other planar segments at any point along a majority of the length of the panel and the circumferential shape of the center portion is a polygon at any point along a majority of the length of the center portion;

further wherein each panel centerline extends at a constant acute angle relative to the longitudinal axis of the bottle, and each panel segment extends from the upper panel end to the lower panel end in a sinusoidal direction about the panel centerline, and each panel segment has an exterior surface that curves inward toward the longitudinal axis of the bottle to define a generally concave surface along a majority of the length of the panel segment.

12. The bottle of claim 11, wherein the center portion has eight planar segments.

13. The bottle of claim 11, wherein the concave external surface of each panel segment defines a radius.

14. A bottle having an open top and a closed bottom, the bottle comprising:

a neck;

a body disposed between the neck and the closed bottom, the body having an upper portion, a center portion and a lower portion, the upper portion and the lower portion being cylindrical shaped and having the same circumferential length, and the center portion having a plurality of panel segments, the panel segments being disposed side-by-side and contiguous around the circumference of the body in a longitudinal and sinusoidal pattern;

wherein each panel segment has a planar exterior surface in the circumferential direction at any point along the length of the panel segment, such that the circumferential shape of the center portion is a polygon at any point along a majority of the length of the center portion, and the center portion has a circumference at any point along a majority of the length of the center portion which is shorter than the circumference of the upper portion and the lower portion.

15. The bottle of claim 14, wherein the center portion has at least six planar segments.

* * * * *